United States Patent [19]

Yamada

[11] Patent Number: 4,948,183

[45] Date of Patent: Aug. 14, 1990

[54] DOOR LOCKING DEVICE FOR VEHICLES

[75] Inventor: Shinjiro Yamada, Nirasaki, Japan

[73] Assignee: Mitsui Kinzoku Kogyo Kabushiki Kaisha, Tokyo, Japan

[21] Appl. No.: 454,609

[22] Filed: Dec. 21, 1989

[30] Foreign Application Priority Data

Dec. 21, 1988 [JP] Japan ..... 63-322960

[51] Int. Cl.[5] ..... E05C 3/26

[52] U.S. Cl. ..... 292/199; 292/201; 292/216

[58] Field of Search ..... 292/199, 201, 216, 337

[56] References Cited

U.S. PATENT DOCUMENTS

| | | | |
|---|---|---|---|
| 3,566,703 | 3/1971 | Van Noord | 292/201 X |
| 4,502,718 | 3/1985 | Sasaki et al. | 292/201 X |
| 4,518,182 | 5/1985 | Cousin et al. | 292/201 |
| 4,624,491 | 11/1986 | Vincent | 292/201 |
| 4,735,447 | 4/1988 | Kleefeldt | 292/216 |
| 4,763,936 | 8/1988 | Rogakos et al. | 292/201 |
| 4,779,912 | 10/1988 | Ikeda et al. | 292/201 X |
| 4,793,640 | 12/1988 | Stewart, Sr. | 292/199 X |

*Primary Examiner*—Eric K. Nicholson

*Attorney, Agent, or Firm*—Browdy and Neimark

[57] ABSTRACT

In the door locking device for vehicles according to the present invention, a motor type actuator for switching the locking device from a locked state to an unlocked state, and vice versa is modularized. A locking lever in this locking device has a first fan-shaped gear portion. The actuator has a motor, reduction gears, a one-way clutch and an output shaft which are supported on a frame. The actuator is set on a mounting portion of a device body and thereafter sealed with a case. The output shaft is provided in parallel with a central shaft of the locking lever, and extends through the case to project beyond the rear surface of the device body. A second fan-shaped gear portion meshed with the first fan-shaped gear portion is mounted fixedly on this projecting portion of the output shaft.

1 Claim, 6 Drawing Sheets

DOOR LOCKING DEVICE FOR VEHICLES

BACKGROUND OF THE INVENTION

This invention relates to a door locking device for vehicles, and more particularly to a door locking device for vehicles, provided with a motor type actuator for use in switching the locking device from a locked state to an unlocked state, and vice versa.

DESCRIPTION OF THE PRIOR ART:

Various types of door locking devices adapted to switch a locking mechanism from a locked state to an unlocked state, and vice versa by an actuator have heretofore been proposed The actuators used in such door locking devices are divided into two groups, i.e. the actuators of the type which are fixed to a locking mechanism, which has a latch means and a release means, by using a bracket, and the actuators of the type which are provided in a housing of a locking mechanism as disclosed in U.S. Pat No. 4,735,447. In recent years, the latter actuators which can be formed to small dimensions have mainly been employed.

However, forming an actuator and a locking mechanism unitarily causes the assembling step to become complicated. Especially, an operation of connecting an output portion of an actuator to a locking lever in a locking mechanism has a high degree of difficulty due to the regulations of the positions of levers and the regulation of meshing condition of a reduction gear in a motor, which are included in this difficult operation. Moreover, when an imperfect door locking device is found out during the examination of complete products, it is necessary to either destroy the imperfect product as a whole or disassemble the same and renew an imperfect part thereof. In both of these cases, the manufacturing cost increases.

SUMMARY OF THE INVENTION:

Therefore, according to the present invention, a motor, reduction gears and a one-way clutch which constitute an actuator are modularized so as to enable a locking mechanism and actuator to be subjected to product examination separately, and fan-shaped gears are provided in an output portion of the actuator and an input portion of a locking lever in the locking mechanism so as to enable the engagement, disengagement and positioning of the gears and the connecting of the locking mechanism and actuator to each other to be carried out easily.

Figure 1:
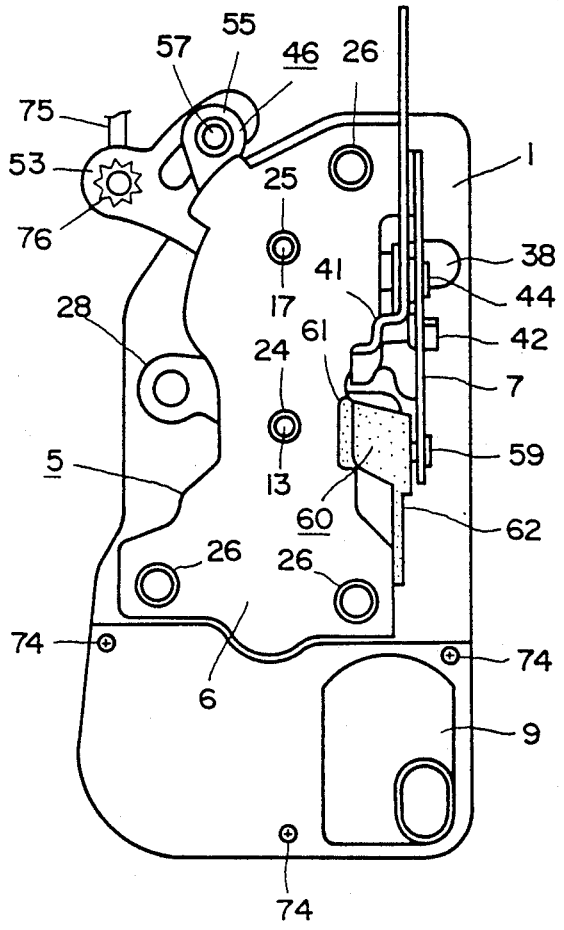
FIG. 1 is a rear elevation of the locking device according to the present invention.
Figure 2:
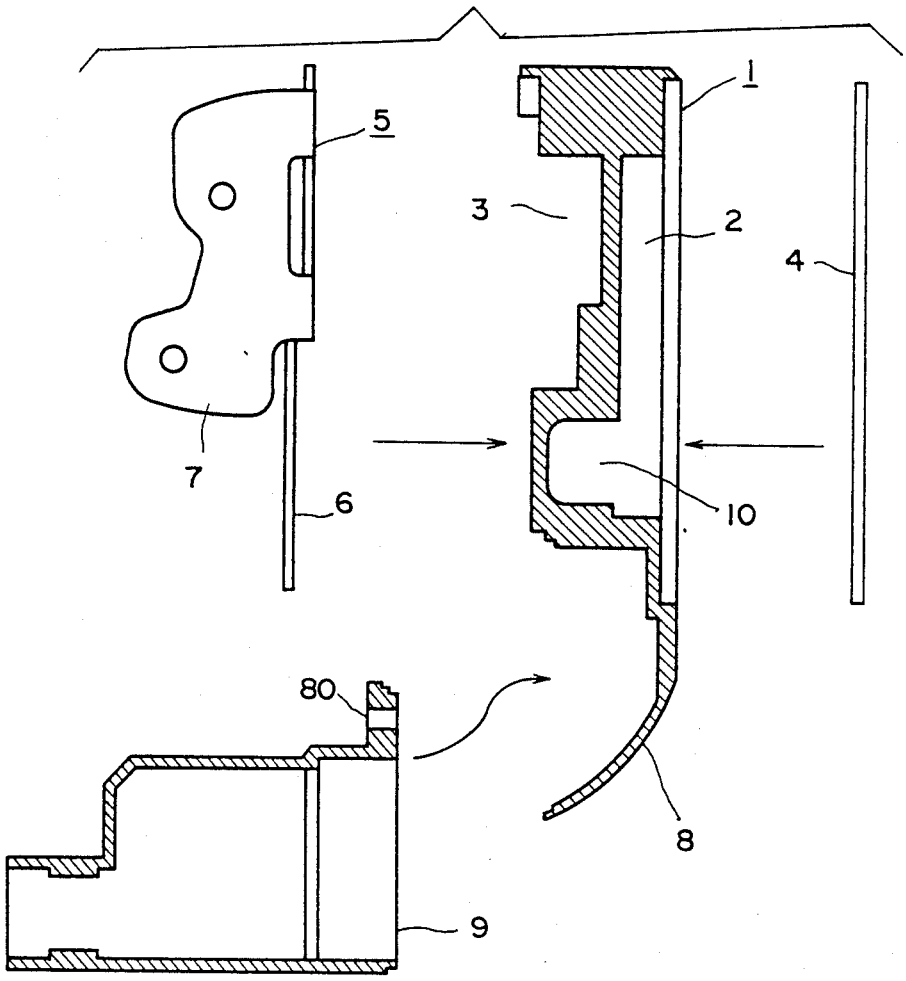
FIG. 2 is an exploded view showing the construction of a frame.
Figure 3:
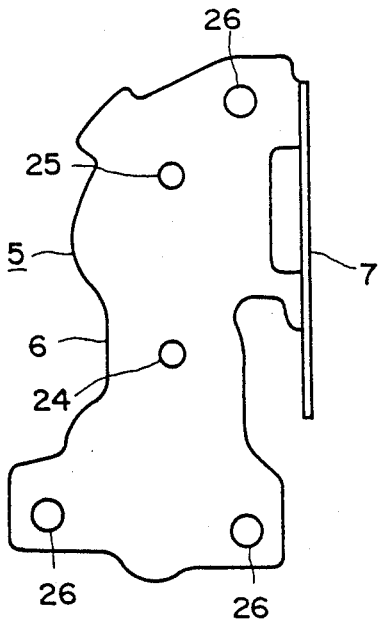
FIG. 3 is a rear elevation of a back plate.
Figure 4:
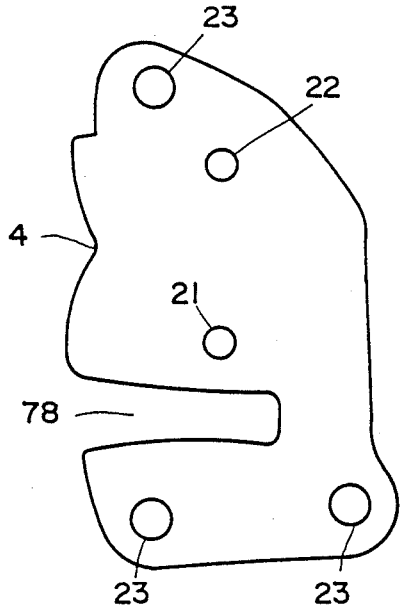
FIG. 4 is a front elevation of a cover plate.

DESCRIPTION OF THE PREFERRED EMBODIMENT:

First, the construction of a general frame or body of the locking device will be described. A reference numeral 1 denotes a locking device body of a synthetic resin, which is provided on its front side with a recess 2 for holding a latch 12 and a ratchet 18 therein, and on its rear side with a mount 3 for levers (FIG. 2). A groove 10 into which a striker 11 fixed to a chassis is moved is formed at the lower portion of the recess 2. A reference numeral 4 denotes a cover plate consisting of a flat metal plate and attached to the device body 1 so as to cover the recess 2 and groove 10. The cover plate 4 is provided as the device body 1 with a deep recess 78 into which the striker 11 is moved.

A reference numeral 5 denotes a back plate consisting of a flat metal plate and composed of a flat portion 6, and a standing portion 7 extending from a side edge of the flat portion 6 at right angles thereto. This back plate 5 is fixed to the rear side of the device body 1 with a clearance left therebetween, and the mount 3 referred to above is formed between the rear side of the device body 1 and back plate 5.

The device body 1 has at the lower portion thereof an actuator mounting plate 8 formed integrally therewith. An actuator case 9 formed out of a synthetic resin independently of the mounting plate 8 is joined to the mounting plate 8 with screws 74 or by fusing.

The basic construction of the general frame of the locking device according to the present invention is as described above, and the mounted condition of levers will now be described.

Figure 7:
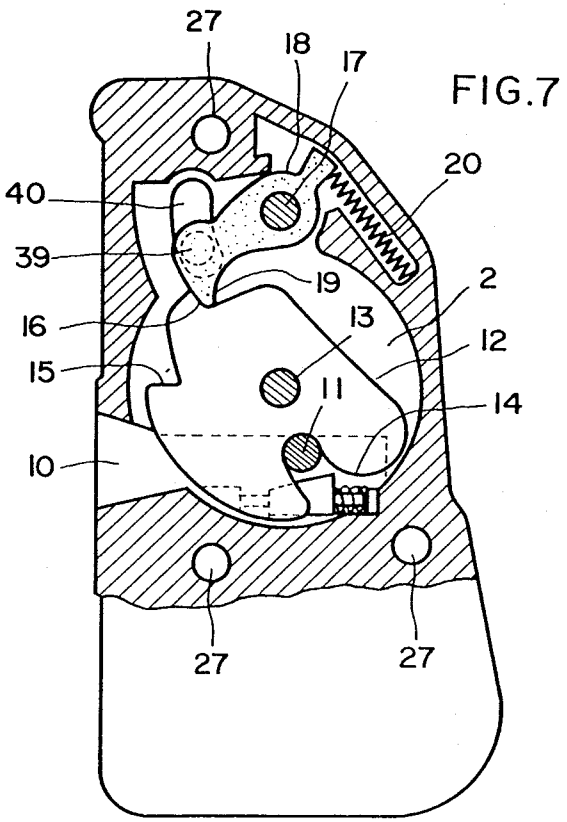
FIG. 7 is a partially sectioned front elevation of a locking device body.

Referring to FIG. 7, a reference numeral 10 denotes a groove 10 into which the striker 11 fixed to the chassis is moved. When a door is closed, the striker 11 enters the groove 10 to engage a locking recess 14 in a latch 12 fixed pivotably in the recess 2 and turns the latch 12 counter-clockwise. When the latch 12 is turned, a ratchet 18 engages a stepped half latch portion 15 and a stepped full latch portion 16 in the mentioned order to prevent the latch 12 from being turned reversely. A reference numeral 20 denotes a spring for constantly bringing a pawl 19 of the ratchet 18 into resilient contact with the latch 12.

A shaft 13 of the latch 12 and a shaft 17 of the ratchet 18 consist of screw shafts provided with threads at their end portions, and the cover plate 4 and back plate 5 are fixed to the device body 1 via these shafts 13, 17. The shafts 13, 17 are inserted into through holes 21, 22 in the cover plate 4, passed through the device body 1 and screwed to shaft inserting bores 24, 25 in the back plate 5.

The locking device is fixed to a door by bolts (not shown) inserted into through holes 23 in the cover plate 4, through holes 27 in the device body 1 and through holes 26 in the back plate 5.

Figure 5:
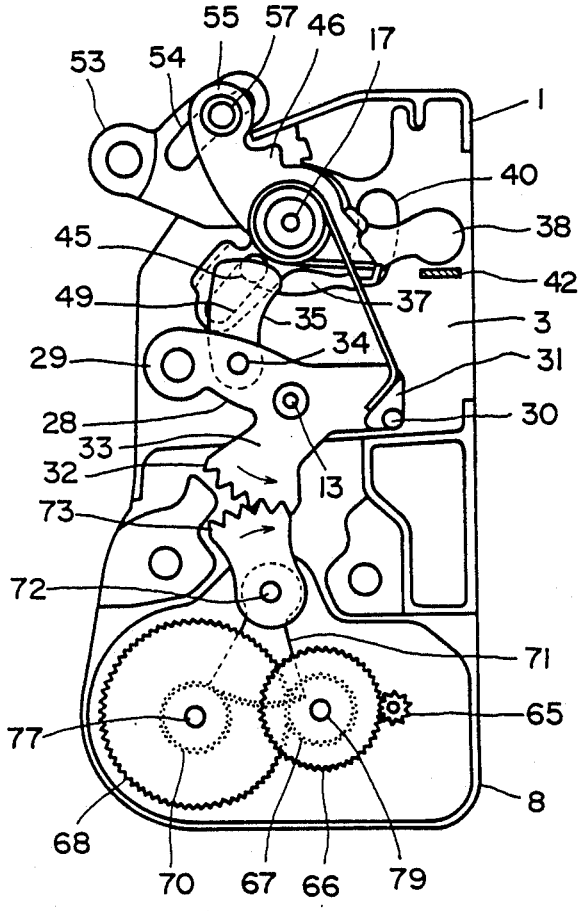
FIG. 5 is a rear elevation similar to FIG. 1 with the back plate and an actuator case removed from the locking, device.

A pivotable member 37 is mounted on the shaft 17 so that the pivotable member 37 can be turned (FIGS. 5 and 9). The pivotable member 37 has a sideward extending arm 38, and a pin 39 is formed at the intermediate portion of the arm 38, this pin 39 being projected from an elongated bore 40, which is formed in the device body 1, into the recess 2 and engaged at its free end portion with the ratchet 18 (FIG. 7). Accordingly, when the arm 38 of the pivotable member 37 is turned in the direction of an arrow a, the ratchet 18 is turned via the pin 39 to cause the latch 12 to be released.

Figure 8:
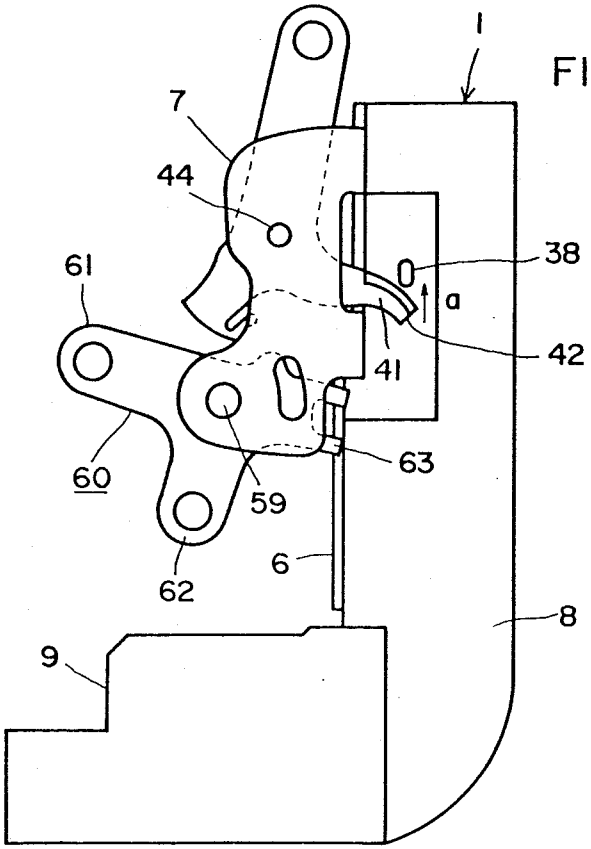
FIG. 8 is a side elevation of the locking device.

A lever 41 adapted to be turned by an inner handle on the door is fixed (FIG. 8) via a shaft 44 to the standing portion 7 of the back plate 5. When the lever 41 is turned by the inner handle, a pivotable end 42 of the lever 41 is turned in the direction designated by a reference letter a to cause the arm 38 to be turned. Therefore, a door opening operation using the lever 41 enables the door to be opened not through a locking mechanism which will be described later.

Figure 10:
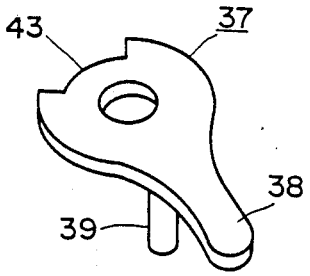
FIG. 10 is a perspective view of the pivotable member.
Figure 9:
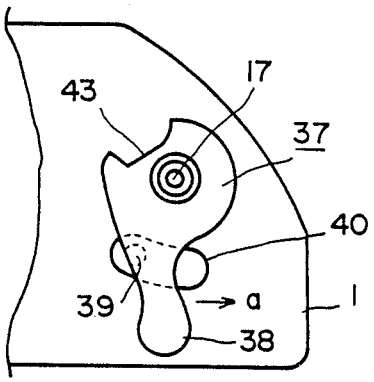
FIG. 9 illustrates the relation between a pivotable member and locking device body.

As shown in FIGS. 9 and 10, a locking recess 43 is formed in the outer circumferential portion of the pivotable member 37, and a projection (FIG. 13) of a connecting member 35 which will be described later is engaged with the locking recess 43 so that the projection 45 can be disengaged therefrom.

Figure 11:
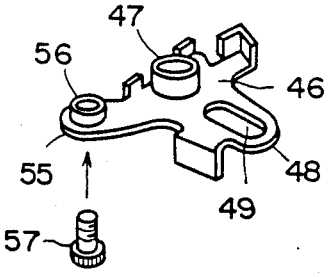
FIG. 11 is a perspective view of an opening lever.

A reference numeral 46 denotes an opening lever (FIG. 11) adapted to be turned by a door opening operation of an outer handle (not shown) on the outer side of the door. A boss 47 is formed at the central portion of the opening lever 46 and fitted around the shaft 17 so that the boss 47 can be turned.

A projection 48 of the opening lever 46 is provided with an elongated bore 49, with which the projection 45 of the connecting member 35 is engaged movably. When the projection 45 is moved to the portion of the elongated bore 49 which is on the side of the boss 47, the projection 45 enters the locking recess 43. When the opening lever 46 is then turned counter-clockwise in FIG. 5, the projection 45 engages the locking recess 43 to turn the pivotable member 37 and cause the ratchet 18 to be turned (unlocked state) by the pin 39 on the pivotable member 37. Conversely, when the projection 45 is moved to the outer end of the elongated bore 49, the projection 45 disengages from the locking recess 43. Even when the opening lever 46 is turned counter-clockwise in FIG. 5, the projection 45 does not engage the locking recess 43, and the pivotable member 37 is not turned (locked state).

Figure 12:
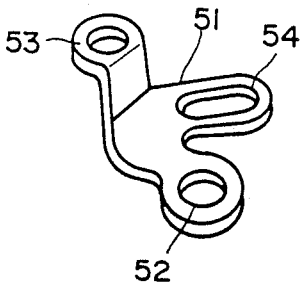
FIG. 12 is a perspective view of a regulating lever.

A reference numeral 51 denotes a regulating lever (FIG. 12) operated when the opening lever 46 and a rod 75 extending to the outer handle on the outer side of the door are connected together. This regulating lever 51 is mounted at its bore 52 on the shaft 17, and an arcuate bore 54, the center of curvature of which is in alignment with the bore 52, and a bore 56 in a projection 55 of the opening lever 46 are joined together by inserting a screw 57 therethrough and tightening the same. Accordingly, the fixing of the rod 75 can be done easily by regulating the angle, at which the opening lever 46 and regulating lever 51 are fixed to each other, by the screw 57 in accordance with the length of the rod 75 which is fitted firmly in a locking bore 53 in the regulating lever 51 by a screw 76.

Figure 13:
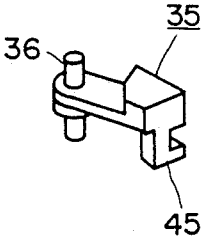
FIG. 13 is a perspective view of a connecting member.

A locking lever 28 is mounted on the shaft 13 so that the lever 28 can be turned. This locking lever 28 is adapted to be turned to a locking position and an unlocking position by hand or by an actuator. The locking lever 28 has a member 29 connected to a sill knob, another member 31 provided with a projection 30, and a fan-shaped arm 33 provided with a toothed portion 32. The member 29 is provided with a hole 34, with which a shaft 36 of the connecting member 35 is engaged (FIG. 13). Accordingly, when the locking lever 28 is in the position shown in FIG. 5, the connecting member 35 is pushed out rightward, and the projection 45 is moved in the elongated bore 49 to the position in which the projection 45 can engage the locking recess 43, so that the locking device is put in an unlocked state. When the locking lever is turned to left in FIG. 5, the connecting member is drawn to left, and the projection 45 is moved in the elongated bore 49 to the position in which the projection 45 does not engage the locking recess 43, so that the locking device is put in a locked state.

The locking lever 28 adapted to be turned by a motor 58 provided in the actuator case 9 is also turned by a lever 60 fixed to the standing portion 7 via a shaft 59.

The lever 60 (FIG. 8) has a projection 61 connected to the sill knob, a projection 62 connected to a key, and a bifurcated portion 63 engaged with the projection 30 of the second member 31 of the locking lever 28. Accordingly, when the sill knob is pressed to turn the lever 60 counter-clockwise, the locking lever 28 is turned to left due to the engagement of the bifurcated portion 63 and projection 30 with each other, and the projection 45 of the connecting member 35 disengages from the locking recess 43, so that the locking device is put in a locked state. When the lever 60 is turned by an operation of the key, the same results can also be obtained.

Figure 6:
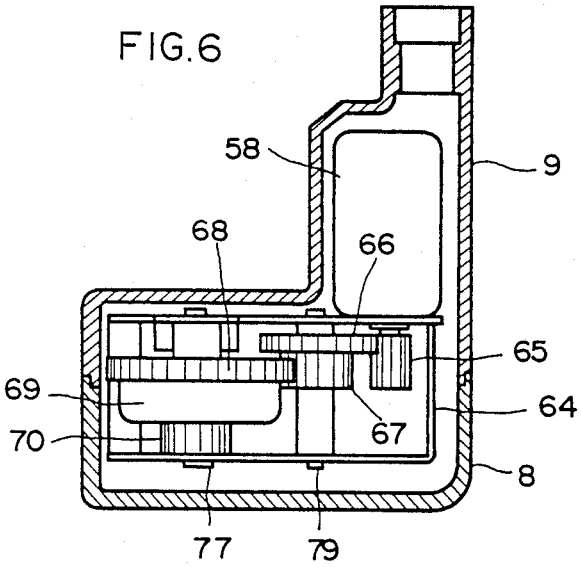
FIG. 6 is a partially longitudinally sectioned elevation of an actuator.

The motor 58 is fixed to a frame 64 held in the actuator case 9 and mounting plate 8. A driving gear 65 for the motor 58 is meshed with a gear 66 mounted fixedly on a shaft 79 (FIG. 6). A smaller-diameter gear 67 is formed integrally with the gear 66, and a gear 68 is meshed with this smaller-diameter gear 67. A clutch means 69 and a gear 70 are mounted on a rotary shaft 77 of the gear 68. The clutch means 69 is adapted to transmit the rotation of the gear 68 when it is rotated by the motor 58, to the gear 70, and not to transmit the rotation of the gear 70 when it is rotated, to the gear 68. A fan-shaped gear 71 mounted fixedly on an output shaft 72 is meshed with the gear 70 (FIG. 5). The output shaft 72 is provided so as to extend in parallel with the central shaft of the locking lever 28. The shafts 72, 77, 79 are supported rotatably on the frame 63.

The actuator consisting of the motor 58, reduction gears and clutch means 69 is fixed wholly to the frame 64, and the resultant frame 64 is held on the mounting plate 8, the actuator case 9 being then put over the mounting plate 8. During this time, the output shaft 72 is projected rearward from a through bore 80 in the actuator case 9.

The actuator case is attached to the mounting plate 8 by a means, such as fusing.

The base portion of the fan-shaped gear 73 is mounted firmly on a projecting portion of the output shaft 72, and the fan-shaped gear 73 is meshed with the toothed portion 32 of the arm 33 of the locking lever 28. Since the gear 73 and arm 33 are formed in the shape of a fan, the connecting of the actuator and locking lever together can be done very simply by merely engaging the fan-shaped gear 73 with the gear 32 from the upper side thereof so that the fan-shaped gear 73 is aligned with the arm 33.

Operation:

When the latch 12 and ratchet 18 are set in the recess 2 in the front side of the device body 1 with the various levers supported on the mount 3 on the rear side thereof, the assembling of the locking mechanism according to a known method is completed.

The motor 58, reduction gears and clutch 69 are supported on the frame 64 to complete the assembling of the actuator. The locking mechanism and actuator are then subjected to product examination separately.

The actuator is then set on the mounting plate 8, and the actuator case 9 is put over the mounting plate 8 and fixed thereto by fusing. The base portion of the fan-shaped gear 73 is mounted firmly on the portion of the output shaft 72 which is projected beyond the rear side of the actuator case 9 via the through bore 80, and the gear 73 is meshed with the toothed portion of the arm 33 of the locking lever 28. Since the output shaft 72 of the fan-shaped gear 73 and the shaft 13 of the locking lever 28 are provided in parallel with each other with both the gear 73 and arm 33 formed in the shape of a fan, the connecting of the actuator and locking lever together in the above operation can be done very simply by merely engaging the fan-shaped gear 73 with the gear 32 from the upper side thereof so that the fan-shaped gear 73 is aligned with the arm 33.

What is claimed is:

1. A door locking device for vehicles, comprising a device body having a recess on the front side thereof, a mounting space on the rear side thereof and a mounting member at the lower portion thereof; a latch and a ratchet supported in said recess so that, when a striker fixed to a chassis engages said latch to turn the latch counter-clockwise, said ratchet disengageably engages said latch to prevent said latch from being reversely turned; an opening lever supported pivotably in said mounting space for connecting to a door handle; a locking lever supported in said mounting space so that said locking lever can be turned between an unlocking position in which said opening lever and said ratchet are engaged with each other, and a locking position in which said opening lever and said ratchet are disengaged from each other, and having a first fan-shaped gear portion; an actuator provided on said mounting member, adapted to switch said locking lever from a locking position to an unlocking position, and vice versa, and having a motor, reduction gears, a one-way clutch and an output shaft which are supported on a frame, wherein said output shaft is provided in parallel with a central shaft of said locking lever; a case attached to said mounting member and sealing said actuator so that only said output shaft of said actuator extends through said case to project from a rear side of said device body; and a second fan-shaped gear portion mounted fixedly on said output shaft and meshed with said first gear portion.

* * * * *